US005801320A

United States Patent [19]

Segan et al.

[11] Patent Number: 5,801,320

[45] Date of Patent: Sep. 1, 1998

[54] FOLDABLE PERCUSSION SYNTHESIZER UNIT

[75] Inventors: Marc H. Segan, New York; Gary Strauss, Mamaroneck; Maxwell Meyer Segan, New York, all of N.Y.

[73] Assignee: M. H. Segan Limited Partnership, Great Barrington, Mass.

[21] Appl. No.: 779,701

[22] Filed: Jan. 7, 1997

[51] Int. Cl.[6] ..... G10D 13/02; G10H 1/057; G10H 3/02

[52] U.S. Cl. ..... 84/738; 84/743; 84/412; 84/DIG. 3

[58] Field of Search ..... 84/738, 743, 411 R, 84/412, DIG. 3, DIG. 12

[56] References Cited

U.S. PATENT DOCUMENTS

D. 316,422 4/1991 Mine .
D. 328,915 8/1992 Sato .
D. 357,271 4/1995 Hoshina .
3,113,480 12/1963 Giarratano ..... 84/411 R
3,433,115 3/1969 Kjelstrom ..... 84/411 R
4,479,412 10/1984 Kylnas .
5,140,889 8/1992 Segan et al. .

*Primary Examiner*—Stanley J. Witkowski
*Attorney, Agent, or Firm*—Cohen, Pontani, Lieberman & Pavane

[57] ABSTRACT

A foldable electronic percussion synthesizer assembly is disclosed that includes two fixed drum heads that are permanently mounted on the synthesizer housing and two movable drum heads that are mounted on respective movable support arms. Each support arm pivots the movable head between a folded position where its striking surface is juxtaposed to and faces the striking surface of a fixed drum head and an unfolded position where the striking surfaces of the fixed and movable head are substantially coplanar and separated from each other. The assembly includes vibration isolation means for each drum head that reduces crosstalk. A latch member is pivotably mounted to the vibration isolation means on the movable drum head to support the movable drum head in the unfolded position and secure the movable drum head on the fixed drum head in the folded position.

13 Claims, 5 Drawing Sheets

8
8
50
105
13
50
106
90
11
64
52
109
108
107
50
19
110
66
90
14
92
50
50
105
50
12
105
50
92

FOLDABLE PERCUSSION SYNTHESIZER UNIT

BACKGROUND OF THE INVENTION

1. Field of the Invention

The present invention is directed to a electronic music synthesizers. More particularly, the present invention is directed to electronic percussion synthesizers.

2. Field of the Invention

In general, music synthesizers are electronic instruments that generate multiple types of sounds from simple, fixed-shape waveforms that are mixed and reshaped electronically under the control of an operator keyboard or other manual control means. The resulting sequences of complex waveforms are then amplified and either recorded or output directly to suitable speakers. More recently, blocks of recorded sound, referred to as sound "samples" have also been combined with the simple waveforms and otherwise modified and manipulated when played back by a synthesizer to form complex sound sequences.

Early sound synthesizers, although capable of generating musical sounds for melody and harmony lines, did not provide a satisfactory substitute for the percussion sounds of conventional musical percussion instruments. Most early synthesizers lacked the striking surface that is indispensable for enabling a synthesizer to control the shape of conventional percussion sounds.

Various devices have recently been marketed which can synthesize the sounds of common percussion instruments, such as drums. These synthesizers provide striking surfaces that generate an analog pulse when they are struck. Sound generator circuits in the synthesizer respond to these analog pulses by generating sounds having an amplitude proportional to the amplitude of the analog pulse. For example, the electronic percussion synthesizer disclosed in U.S. Pat. No. 4,479,412 (the '412 patent), has a plurality of pressure transducers, each representing a different percussion musical instrument. Each pressure transducer generates an analog pulse representing one beat of the respective musical instrument each time it is struck.

A similar percussion synthesizer is described in U.S. Pat. No. 5,140,889 (the '889 patent), the disclosure of which is incorporated herein by reference. However the position of the drum heads is freely adjustable. The mounting of these drum heads permits the angular position of each drum head to be independently set, and a spider support member on each drum head minimizes mechanical dampening of the striking surface by the support and also minimizes crosstalk with the other transducers and drum heads in the drum set.

However, these conventional electronic percussion synthesizers do not provide easy portability because the drum heads cannot be folded relative to their supports. This restricts the usefulness of the synthesizer when travelling, exposes the drum heads to possible damage during transit, and wastes storage space when the synthesizer is not in use. For example, FIG. 1 of the '412 patent shows a electronic percussion synthesizer unit having four drum heads that are fixed in position relative to each other and relative to the unit's housing. Similar structures are shown in U.S. Design Pat. Nos. 5,140,889, Des. 357,271; Des. 328,915; and Des. 316,422.

SUMMARY OF THE INVENTION

In accordance with the present invention, a percussion synthesizer unit having foldable, vibration isolating drum head supports is provided. Multiple separate striking surfaces for controlling the synthesizer's percussion sounds are provided by a synthesizer unit that is inexpensive, compact and portable, but opens so that the striking surfaces are separated by enough distance to accomodate play.

The foldable electronic percussion synthesizer assembly includes a drum-synthesizer housing affixed to a stationary drum head and a movable drum head pivotably mounted to the drum synthesizer housing via a movable support arm. The movable drum head can be pivoted from a folded position where the movable drum head is juxtaposed to the fixed drum head to an unfolded position away from the fixed drum head and coplanar with it, at a distance from the fixed head that is convenient for use by the synthesizer operator.

In a preferred embodiment the support arm also includes a dual purpose latch member. When the drum heads are folded together for transport or storage with the movable drum head in proximity to the fixed drum head, the latch member prevents the movable drum head from unfolding. This latch member also provides support to the movable drum head when the movable drum head is in the unfolded position.

Preferably the latch member is mounted to isolation means for dampening conduction of the vibration of the movable drum head. When the movable drum head is in its unfolded position, the isolation means reduces conduction of vibration between the drum-synthesizer housing and the movable head, thereby minimizing crosstalk between the transducers responsive to the respective drum heads.

The invention provides a cost effective electronic percussion synthesizer assembly which is compact, durable, readily portable and reliable.

BRIEF DESCRIPTION OF THE DRAWINGS

The features and advantages of the invention will be better understood when the detailed description of the preferred embodiments, given below, is considered in conjunction with the drawings provided, wherein.

In these drawings like reference numerals are assigned to like elements.

DETAILED DESCRIPTION OF THE PRESENTLY PREFERRED EMBODIMENTS

Figure 1:
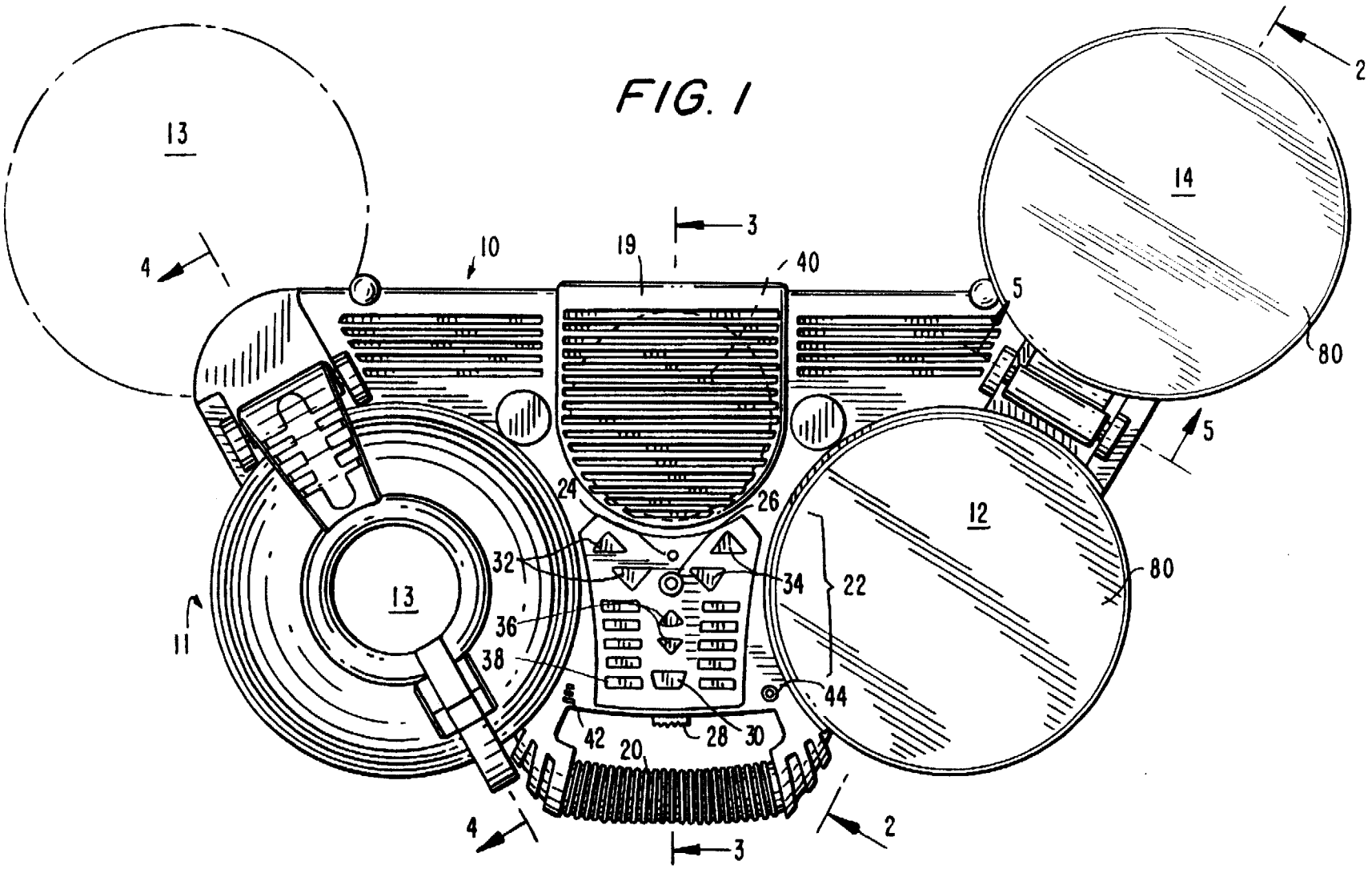
FIG. 1 is a top view of the foldable drum set in accordance with the present invention with two movable drum heads, one in a folded position and the other in an unfolded position.
Figure 3:
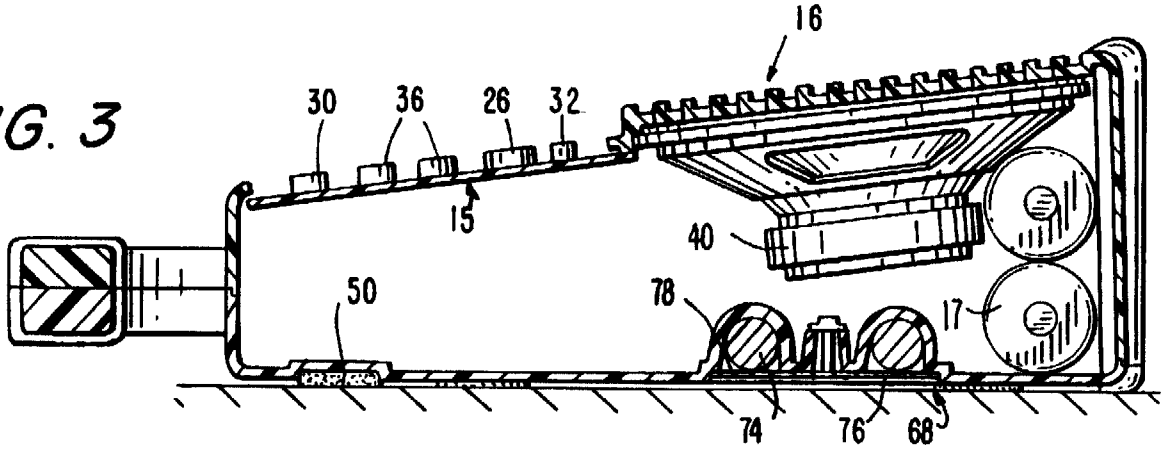
FIG. 3 is a view along line 3—3 of the movable drum head in the folded position and the latch means in its latching position.

FIG. 1 shows a drum synthesizer housing 10 in accordance with the present invention, having first and second fixed drum head assemblies 11, 12, and first and second movable drum head assemblies 13, 14. The drum synthesizer housing 10 has a carrying handle with a suitable gripping surface, such as ribs or some other non-slip surface. The control panel 22 adjacent the handle 20 includes a pilot light 24, head phone jack 26, volume control 28, demo start 30, last/next feature selectors 32, up/down pitch and speed control 34, 36, and ten sound-sample selector buttons 38. The control panel 22, a speaker 40, on/off and pause buttons (not shown), an integral microphone 42 and a microphone jack 44 are provided on the upper control surface 16 of the housing 10. The panel 22 provides user control of a synthesizercontrol circuit board 15 which is located inside the housing 10 with the batteries 17, as shown in FIG. 3.

Figure 4:
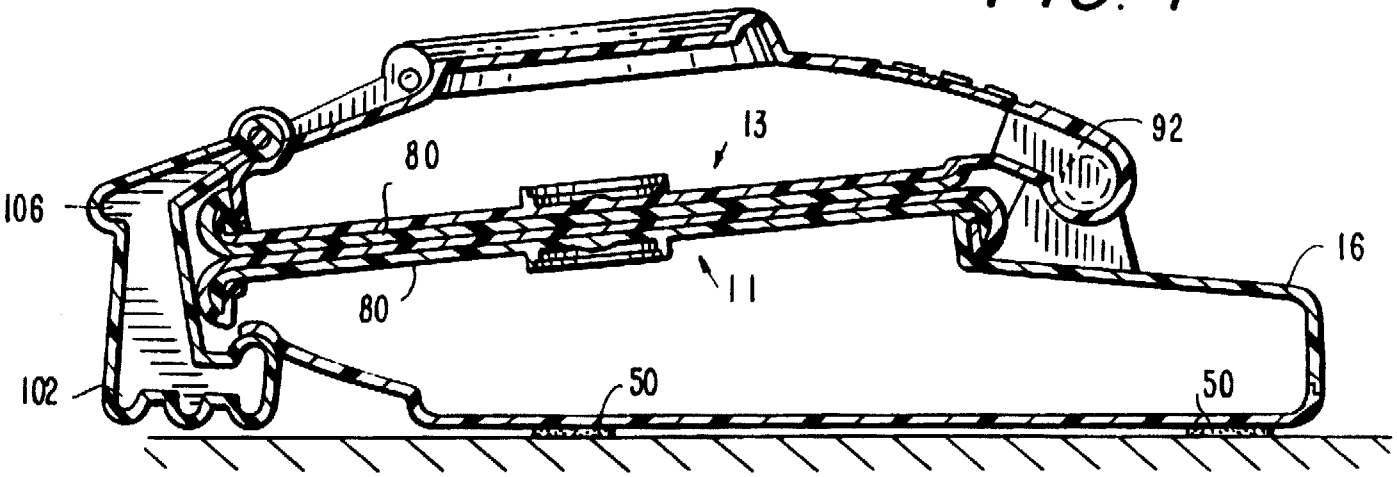
FIG. 4 is a cross sectional view along line 4—4 of the drum synthesizer housing of the foldable drum set shown in FIG. 1.
Figure 6:
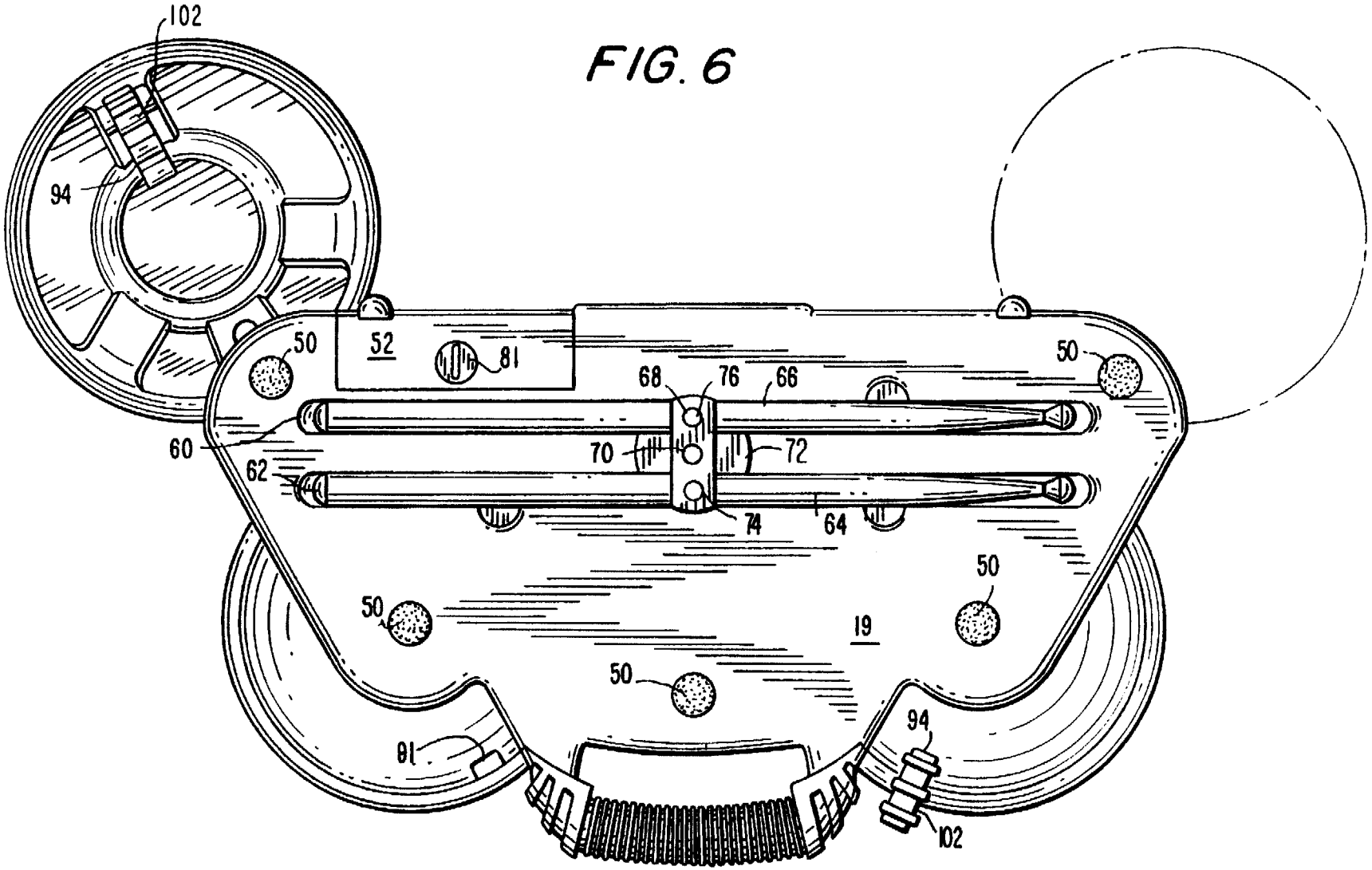
FIG. 6 is a bottom view of the foldable drum set shown in FIG. 1.

Feet 50 are provided on the lower support surface 19 of the synthesizer housing for resting it on a table surface, as shown in FIGS. 4 and 6. A battery access door 52 on the same surface 19 provides access to the batteries 17 (shown in FIG. 3) that provide power for the drum synthesizer circuit board 15. Two parallel drum stick cavities 60, 62 are also provided in the support surface 16 of the housing 10. The drum stick cavities 60, 62 are shaped to accommodate a pair of drum sticks 64, 66, respectively, that are stored lengthwise within the drum synthesizer housing 10.

A drum stick clip 68 prevents the drum sticks from falling out of the cavities 60, 62 when the foldable drum set is transported or stored. The drum stick clip 68 includes a pivot 70 and a recess 72 in the support surface that permits rotation of the clip 68. Diametrically opposed indentations 74, 76, shaped to accommodate two of the operator's fingers are provided on the top surface of the clip 68 to aid in rotating it to release the drum sticks 64, 66. Preferably a resilient generally rectangular-shaped wedge member 78 is mounted to the underside of the clip 68, having a width at least as wide as the width of one of the drum sticks. The length of the wedge member 78 is approximately equal to the distance across the drum stick cavities 60, 62. In any event, the clip 68 should be made wide enough to provide good rotary leverage and convenient spacing for the two finger-hold indentations 74, 76. In the figures, because the drum stick cavities are spaced apart from each other, the ends of the wedge member 78 are substantially aligned with the perimeter of the clip 68.

The circular clip cavity 72 within which the drum stick clip 68 is received extends beyond the width of the two drum stick cavities 60 and 62. To lock the drum sticks 64, 66 in the housing 10, the clip 68 is rotated until the wedge member 78 attached to the underside of the clip 68 extends into the drum stick cavities 60 and 62 perpendicular to their length, so that drum sticks 64, 66 stored in those cavities 60, 62 are secured there by frictional engagement with that wedge member 78. Inexpensive releasable locking means actuated by a rotatable locking disc 81 for securing a,battery access door is well known, but particularly advantageous here in that its rotary operation is consistent with the rotary operation of the clip 68. Alternatively, the drumsticks may be secured in a single cavity 106 by the combination of a latch 109 and an overhang such as the tabs 110 shown in FIG. 7.

Preferably, the set of striking surfaces provided by the percussion synthesizer includes two pairs of complementary drum heads, each pair including a fixed drum head assembly and a movable drum head assembly. The heads in each complementary pair are preferably circular, as in FIG. 1, but may be rectangular, or any other convenient shape. Additional striking surfaces may be attached to the synthesizer unit for the convenience of the operator in controlling multiple synthetic percussion sounds. One complementary drum head pair 11, 13 shown in FIG. 1 is in its folded state while the other complementary drum head pair 12, 14 is unfolded.

The striking surface 80 of the drum heads 11, 12, 13, 14 shown in FIG. 1 is preferably made of a resilient plastic, such as polypropylene. The striking surfaces 80 are substantially planar, but have a curved outer rim 82 surface. A piezoelectric sensor 84 is supported against the underside of each striking surface by a rigid ABS or styrene plastic disc 86 pressed against the head by a recessed ring **80*a* that is molded as an integral part of the respecrive head 11, 12, 13, 14. The sensor is connected by wires (not shown) to the drum synthesizer circuit board 15. The sensor 84 produces an analog signal representing the force applied to the striking surface 80** of the drum head, as is well known in the art.

The rise time and mix of waveforms in the pulses produced by each drum head are independently selectable. In particular, the feature select buttons 38 provide sampled sounds and sound sequences suitable for respective musical styles. Any sound output can be increased or decreased in speed and pitch by respective up/down buttons 34, 36. A demo sequence, providing sequential samples of some of the sounds available, is executed automatically when the "demo start" button 30 is pressed. Voice and sound-effects samples may also be recorded using a microphone 42, 44, for inclusion in the synthesizer's rhythm sequence. As synthesizer circuit boards 15 suitable for this application are well known, a further description is unnecessary. Suffice to say that all the sound features contemplated for the device of the present invention may be readily imlemented by those skilled in the art.

The support frame 88 around the sensor mounting plate 86 that holds the head 80 against the enclosure 10, and the enclosure, are preferably made of a dense, rigid plastic material, such as ABS plastic. The edge of the support frame is further stiffened by a circular rib that passes outside of the piers where screws are inserted to clamp the support frame 88 to the enclosure 10. This combination of the support frame 88 and the mounting ring **80*a* with the head 80 and the enclosure 10 in the preferred embodiment are advantageous for the responsiveness and durability of the sensor 84 in this structural configuration, the firm, stable attachment of the head 80 to the enclosure 10**, and simple fabrication and easy assembly.

Figures 7, 8:
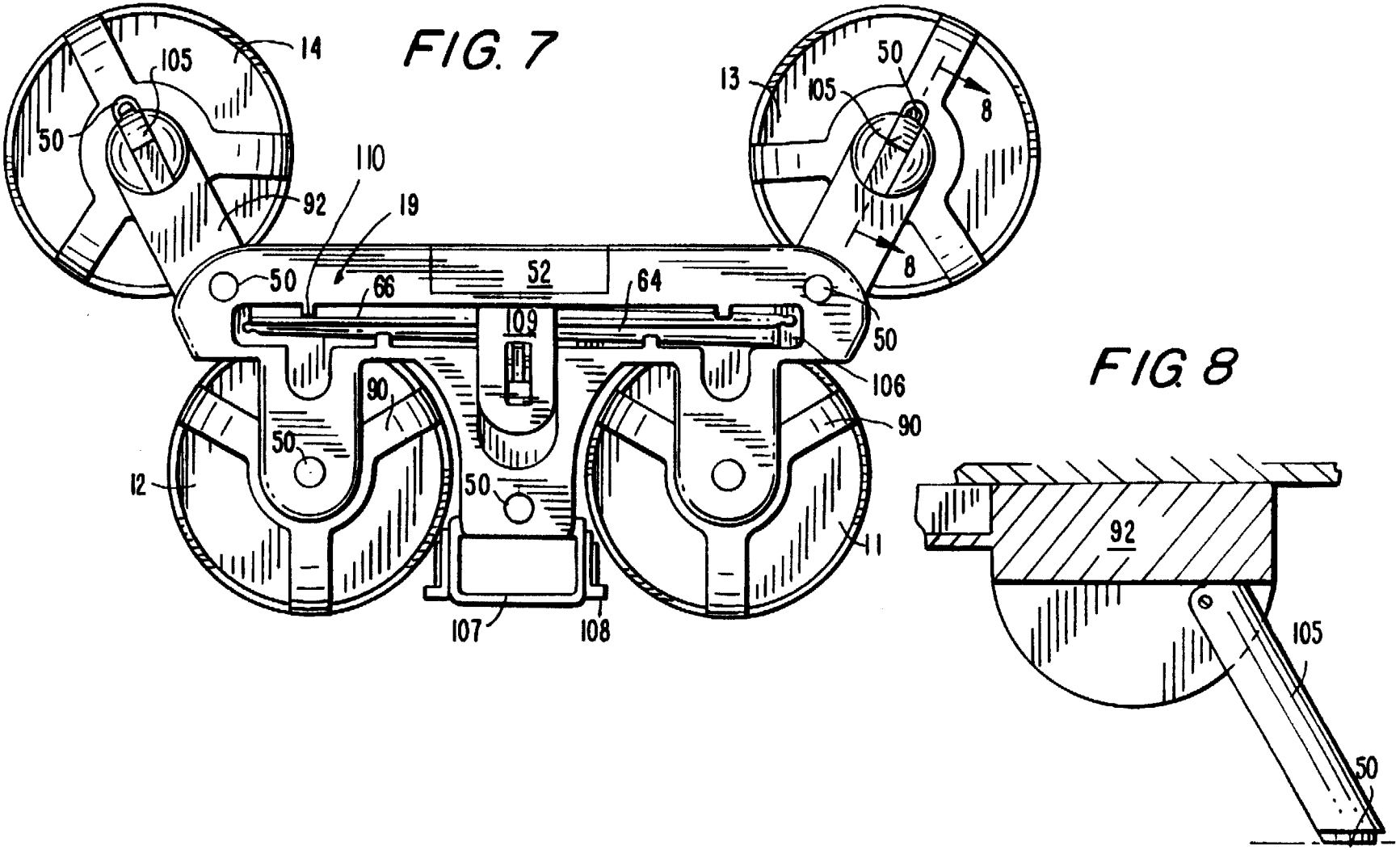
FIG. 7 is a bottom view of a second embodiment of the invention.
FIG. 8 is a side-view detail of the hinged support foot shown in FIG. 7.

Since all of the drum heads 80 in the foldable drum sets in accordance with the present invention are mechanically linked together at the drum synthesizer housing, the vibratory motion imparted to one drum head is at least partially transmitted to the other drum heads, causing their respective piezoelectric sensors 84 to produce unintended analog outputs or "crosstalk" without directly being hit. Mass and distance between the drum heads reduce the amplitude of the vibrations transmitted to other drum heads in this way. Thus the more compact and lightweight the synthesizer unit is, the less distance and mass there is between the heads and the more important it is to provide supplemental means for isolating the drum heads from each other. In FIG. 7 the bowed legs that contact the rim 82 of each drum head 80 are somewhat flexible, so that they act as shock absorbers that dampen the vibratory motion transmitted from the heads to the respective support arms. However, such spring-loaded members are difficult to assemble. It has been discovered that separately mounting the sensor 84 to the flexible head 80 and clamping the flexible head 80 between the support frame 88 and the housing 10 provides adequate acoustic isolation for the striking surfaces 80, without the spider-like three-legged isolation frame 90 shown in FIG. 7.

Figure 2:
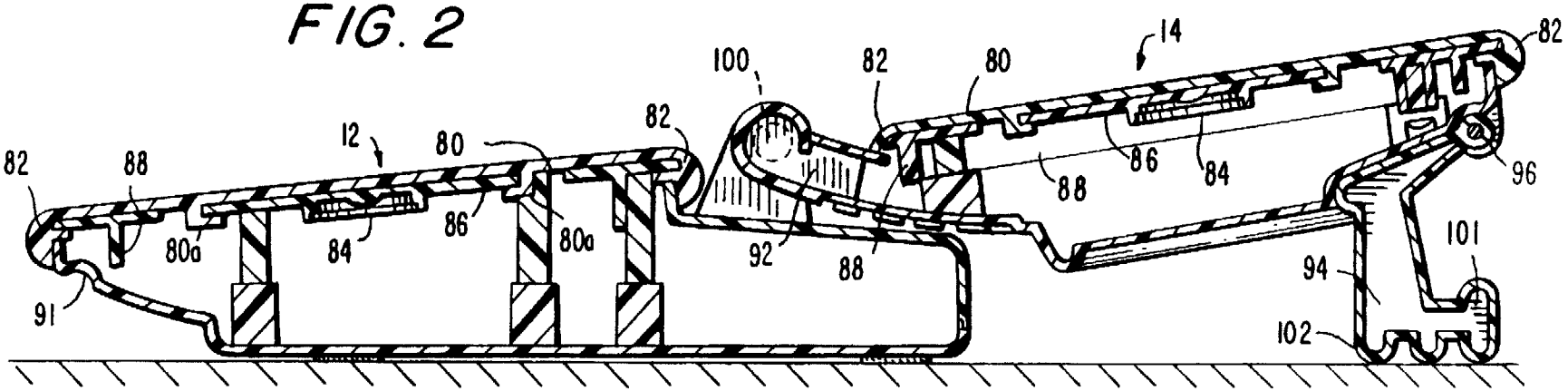
FIG. 2 is a view along line 2—2 of the movable drum head in the unfolded position and a latch means in its supporting position.
Figure 5:
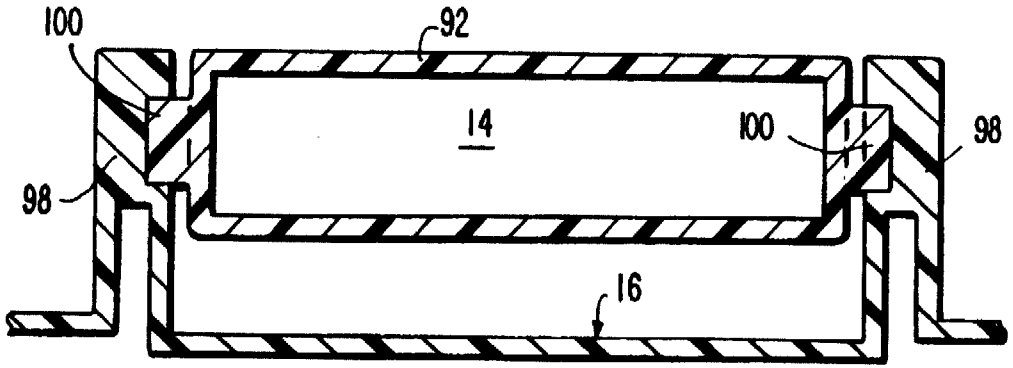
FIG. 5 is a cross sectional view of the hinge along line 5—5 of the drum synthesizer housing in the foldable drum set shown in FIG. 1.

A latch notch 91 is located on the housing adjacent to the outer ring 82 of the striking surface 80 on each fixed head assembly 11, 12, as shown in FIGS. 2 and 4. The movable drum head assemblies 13, 14 are mounted on a pivoting support arm 92 so that the movable drum head assembly can be swung open from a folded position to an unfolded position. At the opposite end of the movable head assembly 13, 14, from the pivotable support arm 92 a latch 94 is attached by a pivot pin 96 extending through the housing 10. The support arm 92 is attached to a pivot frame 98 on the control surface 16 of the housing 10 by molded pivot blocks 100, shown in FIGS. 2, 4 and 5. This simplifies assembly, and also provides lateral stability when the movable drum head assemblies 13, 14 are swung between open and closed positions. Preferably the pivot frame 98 is also integral with the control surface 16 of the drum synthesizer housing 10, to reduce the number of parts manufactured, thereby reducing the cost of assembly.

When the drum set is folded for storage or transport, the striking surface 80 of each movable drum head assembly 13, 14 is juxtaposed to and faces the striking surface 80 of the respective fixed drum head assembly 11, 12. In the unfolded position, the movable drum head assembly 13, 14 has swung open through approximately a 180-degree arc to a position in which its striking surface is substantially coplanar with the striking surface of the fixed head assembly, being angled only slightly toward the handle 20 of the drum set for ease of use.

The latch 94 pivotally mounted to each movable drum head assembly 13, 14 serves a dual function. When the movable drum head assembly 13, 14 is in the folded position, the latch 94 secures the juxtaposed striking surfaces of the respective pairs of drum head assemblies 11, 13 and 12, 14 so they can be transported or stored. The latch 94 is a generally hook-shaped with a hook rib 101 opposite one end of the ribbed foot surface 102. When the movable drum head assembly 13, 14 is unfolded into the playing position while the synthesizer is resting on a flat surface, the ribbed foot surface 102 of the latch 94 contacts that flat surface while the latch 94 lies along the surface of and firmly supports the housing 10 of the movable drum head assembly 13, 14. When the hook rib 101 of the latch 94 engages the latch notch 91, locking the respective pair of head assemblies together, the ribbed foot surface 102 and an additional knee rib 106 provide a hand hold for easy opening of the latch 94. Alternatively, the movable heads may be supported by respective pivotable legs 105, and the latch may be a single-purpose hook 108 mounted on an alternative handle structure 107, as shown in FIGS. 7 and 8.

The invention has been described with particular reference to a preferred embodiment thereof. It will be apparent to one skilled in the art that many modifications and variations are possible within the spirit and scope of this invention. Also, one of the drum heads may be a resilient surface affixed to a solid back that also supports the transducer forming a structure that is similar to a practice pad or a wood block, rather than suspending the drum head over air. The invention is defined by the appended claims.

What is claimed is:

1. An electronic percussion synthesizer assembly, foldable so as to be compact in size and portable, said assembly comprising:

a housing having a top surface, a bottom surface, an electronic control panel with associated electronic circuitry and a fixed drum head having a striking surface electrically connected to the electronic circuitry for producing synthesized electronic sounds when struck; and a movable drum head having a striking surface for producing synthesized electronic sounds when struck, said movable drum head being joined by electrical connections to the control panel of said housing and being pivotally mounted to said housing so as to be adjustable between a folded position, in which the striking surface of said movable drum head is juxtaposed to the striking surface of said fixed drum head, and an unfolded position, in which said movable drum head is rotated by a predetermined angle relative to said fixed drum head so that the striking surfaces of said movable and fixed drum heads are exposed for striking, and wherein the electrical connections between said movable drum head and the control panel of said housing are maintained when said movable drum head is in the unfolded position.

2. The percussion synthesizer assembly of claim 1, wherein said movable drum head rotates through approximately a 180-degree arc between said folded and unfolded positions.

3. The percussion synthesizer assembly of claim 2, further comprising:

a curved edge along the perimeter of said respective contact surface of each drum head, said curved edge forming an outer rim for said head; and a transducer adjacent to a surface of each drum head, said transducer converting vibratory motion caused by striking said contact surface to an electrical signal.

4. The percussion synthesizer assembly of claim 3, further comprising:

an isolation frame secured within the outer rim of said contact surface, said isolation frame comprising an outer ring and a central ring with at least two radial dampening legs connected to the outer ring and the center ring; and a back enclosure interposed between said contact surface and said isolation frame.

5. The percussion synthesizer assembly of claim 3, further comprising a rigid planar support supporting said transducer against said drum head, said planar support being attached to said drum head so as to be suspended by said drum head.

6. The percussion synthesizer assembly of claim 1, wherein said mounted drum head is pivotably mounted to said synthesizer by a pivot comprising:

a support arm bracket having recesses therein and integral to said synthesizer housing;

a movable support arm connected to said pivot block on either side of said movable support arm received within said recesses in said support arm bracket thereby forming a pivot axis about which said movable support arm may be rotated between the folded position and the unfolded position.

7. The percussion synthesizer assembly of claim 1, further comprising a latch pivotally mounted on said movable head so that said latch is rotatable between a supporting position wherein said latch provides support to said movable drum head when in the unfolded position and a latching position wherein said latch secures said movable drum head when in the folded position to said fixed drum head.

8. The percussion synthesizer assembly of claim 7, wherein said latch comprises:

a generally hook-shaped latch member having a first end with a circular channel extending laterally therethrough;

a latch bracket having recesses therein and mounted to one of the dampening legs;

a latch pin passing through the circular channel of said latch member and secured within the recesses of said latch bracket thereby forming a pivot about which said latch member may be rotated between the latch position and the support position.

9. The percussion synthesizer assembly of claim 8, wherein the latch member has a bulbous second end and a stopping member positioned between the first and second ends of said latch member, and wherein the central ring of said movable drum head has a stopping notch and the outer ring of said fixed drum head has a latch notch;

whereby when said latch member is in the supporting position the stopping member is secure within the stopping notch and when said latch member is in the latching position the bulbous second end is secure within the latch notch.

10. The percussion synthesizer assembly of claim 1, further comprising a carrying handle attached to said synthesizer housing; and a latch pivotably mounted on either side of said carrying handle.

11. The percussion synthesizer assembly of claim 7, wherein said synthesizer housing has two substantially parallel drum stick cavities generally defined by a pair of drum sticks and extending longitudinally through said synthesizer housing for storing the pair of drum sticks therein.

12. The percussion synthesizer assembly of claim 11, further comprising a drum stick clip along the bottom surface of said synthesizer housing and including a clip disc mounted to and separated from a wedge member by a distance approximately equal to at least a width of one of the drum sticks, wherein the wedge member has a width approximately equal to a distance between the drum stick cavities and whereby the drum stick clip when rotated secures the drum sticks between the clip disc and wedge member.

13. The percussion synthesizer assembly of claim 9, wherein said synthesizer housing has an aperture extending from the top surface through the bottom surface thereby forming a carrying handle, said carrying handle having gripping means to prevent slippage.

* * * * *